US007412959B2

(12) United States Patent
Wolf et al.

(10) Patent No.: US 7,412,959 B2
(45) Date of Patent: Aug. 19, 2008

(54) MANUALLY GUIDED IMPLEMENT

(75) Inventors: Günter Wolf, Oppenweiler (DE); Bernhard Dürr, Stuttgart (DE)

(73) Assignee: Andreas Stihl AG & Co. KG (DE)

( * ) Notice: Subject to any disclaimer, the term of this patent is extended or adjusted under 35 U.S.C. 154(b) by 472 days.

(21) Appl. No.: 11/168,727

(22) Filed: Jun. 28, 2005

(65) Prior Publication Data

US 2006/0000438 A1 Jan. 5, 2006

(30) Foreign Application Priority Data

Jul. 1, 2004 (DE) ..... 10 2004 031 866

(51) Int. Cl.
*F02B 75/06* (2006.01)
*F02B 77/04* (2006.01)
*B25D 17/24* (2006.01)

(52) U.S. Cl. ..... 123/198 E; 30/381; 173/162.2

(58) Field of Classification Search ..... 123/198 E, 123/192.1; 30/381; 173/162.2; 267/137
See application file for complete search history.

(56) References Cited

U.S. PATENT DOCUMENTS 3,728,793 A 4/1973 Makinson et al.
5,016,355 A * 5/1991 Gassen et al. ..... 173/162.1
5,018,492 A 5/1991 Wolf et al.
5,046,566 A * 9/1991 Dorner et al. ..... 173/162.2
5,361,500 A * 11/1994 Naslund et al. ..... 30/381

FOREIGN PATENT DOCUMENTS

| | | |
|---|---|---|
| GB | 1224822 | 3/1971 |
| SU | 939187 | 6/1980 |
| SU | 1359114 | 12/1987 |
| SU | 1412947 | 7/1988 |
| SU | 1395488 | 5/2008 |

* cited by examiner

*Primary Examiner*—Noah Kamen
(74) *Attorney, Agent, or Firm*—Robert W. Becker & Associates; Robert W. Becker

(57) ABSTRACT

A manually guided implement having a housing that accommodates an internal combustion engine for driving a tool. At least an upper handle extends in a longitudinal direction of the implement on an upper side thereof. A first antivibration element connects the handle to the housing, wherein a longitudinal central axis of the antivibration element is inclined relative to a longitudinal central plane of the implement.

20 Claims, 7 Drawing Sheets

Fig. 6
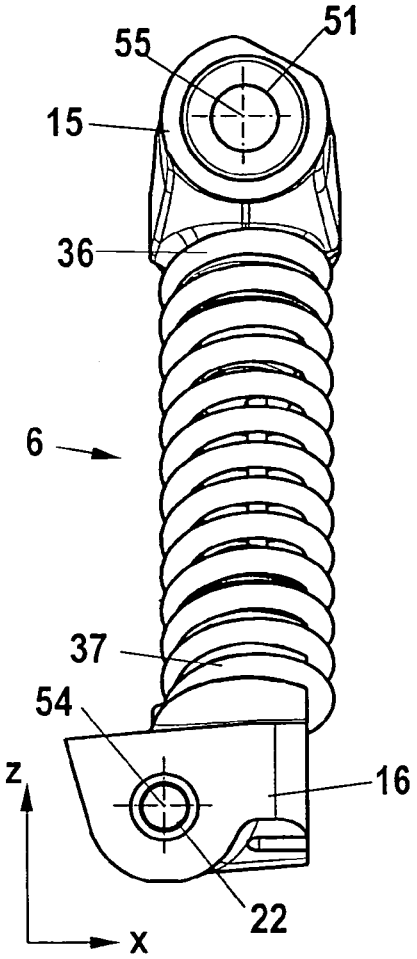
Fig. 7
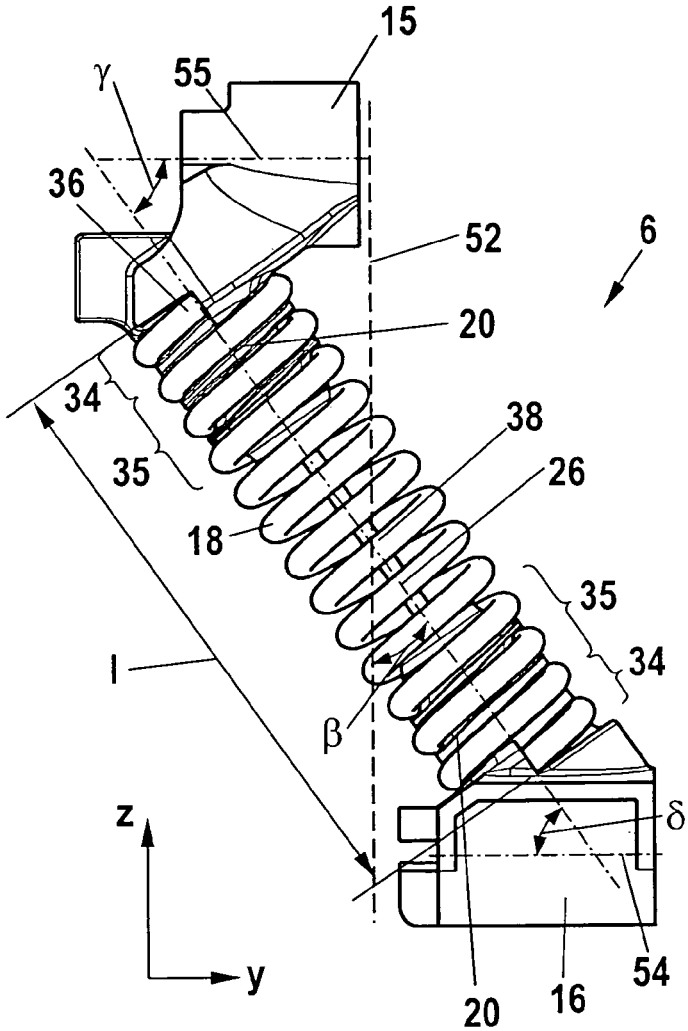
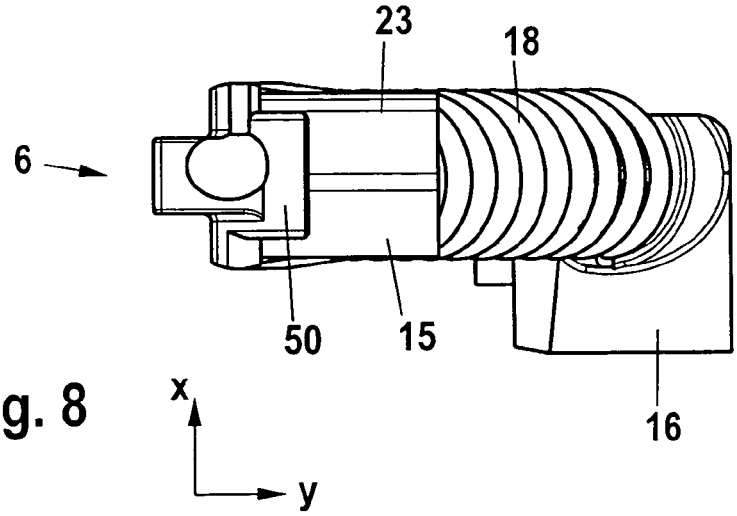
Fig. 8

MANUALLY GUIDED IMPLEMENT

BACKGROUND OF THE INVENTION

The present invention relates to a manually guided implement, especially a power saw, a cut-off machine, or the like.

A power saw having an upper handle is known from U.S. Pat. No. 5,018,492. The ends of the handle are connected to the housing of the power saw via respective rubber antivibration elements. An only very limited installation space is available for the antivibration elements. These antivibration elements are disposed in the transverse direction of the implement, perpendicular to the longitudinal central plane of the implement. Due to the limited installation space, other antivibration elements, such as coil springs, cannot be installed in this position, so that an optimal adaptation of the dampening characteristic is not always possible.

It is therefore an object of the present invention to provide an implement of the aforementioned general type that has a small overall size and good dampening properties.

BRIEF DESCRIPTION OF THE DRAWINGS

This object, and other objects and advantages of the present invention, will appear more clearly from the following specification in conjunction with the accompanying schematic drawings, in which:

FIGS. 6 to 8 are respective side views of the antivibration element;

SUMMARY OF THE INVENTION

Figure 1:
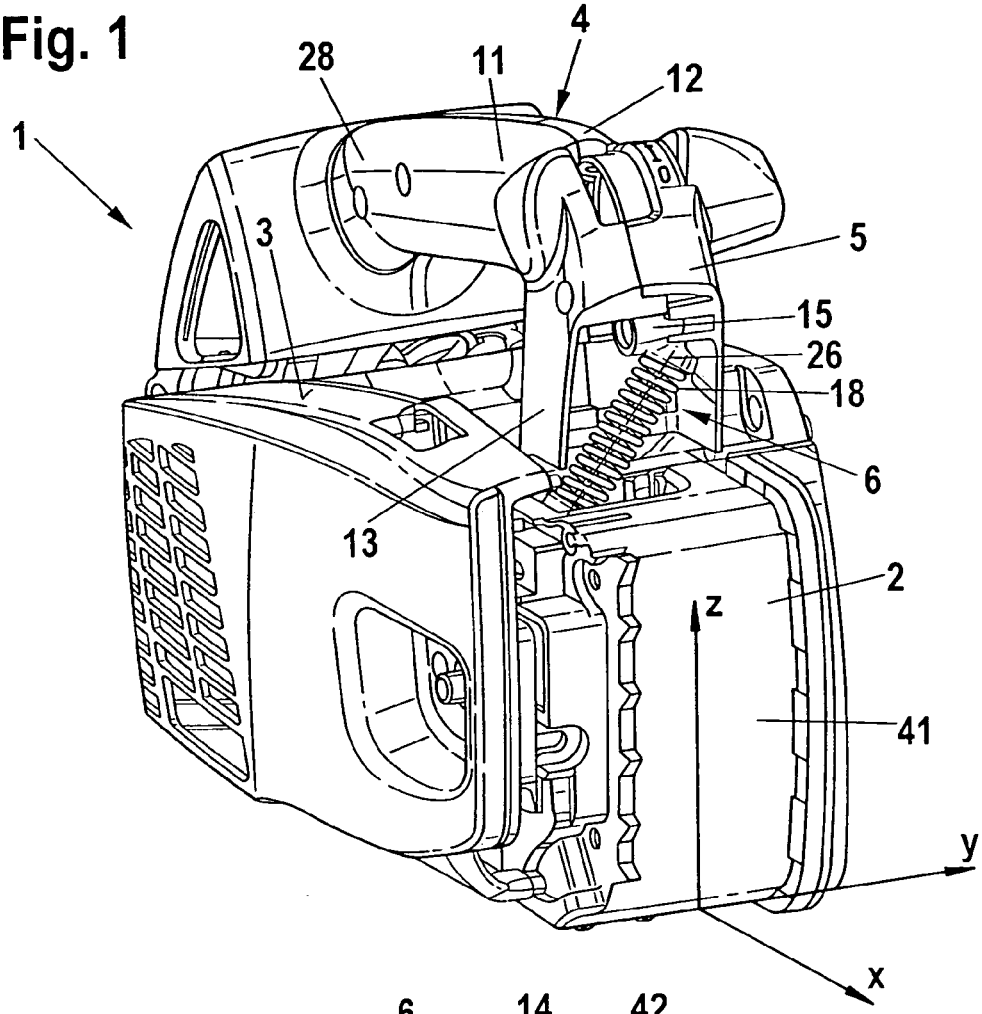
FIG. 1 is a perspective view of a power saw having a handle that is partially sectioned in the transverse direction.

The manually guided implement of the present application comprises a housing which accommodates an internal combustion engine that drives a tool; at least an upper handle that extends in a longitudinal direction of the implement on an upper side of the implement; and a first antivibration element for connecting the upper handle to the housing, wherein a longitudinal central axis of the antivibration element is inclined relative to a longitudinal central plane of the implement.

As a consequence of the inclination of the longitudinal central axis of the antivibration element relative to the longitudinal central plane of the implement, the antivibration element can have a greater length without changing the dimensions of the implement. As a result, the dampening properties of the antivibration element can be better adapted; in particular, the dampening can be made softer. The design of the antivibration element is less a function of the overall size of the implement since the antivibration element can be fit better into the installation space that is available due to the inclination relative to the longitudinal central plane.

Pursuant to one embodiment, the first antivibration element connects a first end of the upper handle that faces the tool to the housing. In particular in the front region of the implement that faces the tool, the installation space that is available is limited by the internal combustion engine, so that only a small installation space is available for the antivibration element. Due to the inclination of the antivibration element relative to the longitudinal central plane, the antivibration element can be secured to the housing of the implement laterally adjacent to the internal combustion engine, so that the installation space that is available can be well utilized. The first antivibration element is advantageously connected to the handle via a first connection element, and to the housing via a second connection element. A simple assembly of the implement can be achieved by respectively securing the connection elements to the housing and the handle respectively via at least one securement or fastening element, in particular a screw. To simplify the assembly, pursuant to one embodiment both connection elements are assembled in one direction. As a result, the antivibration element can be completely assembled in one position of the implement, thus reducing assembly time. At least one connection element advantageously has a bore for a fastening element, whereby the longitudinal central axis of the bore is inclined relative to the longitudinal central axis of the antivibration element.

To achieve a good dampening effect, pursuant to one embodiment the first antivibration element includes a coil spring. Since antivibration elements having coil springs require a large installation space, the inclination relative to the longitudinal central plane of the implement is particularly advantageous with such antivibration elements. The coil spring is expediently held at at least one end on a guide means. The guide means is in particular in the form of a thread. As a result, the coil spring can easily be screwed into the guide means. It is easy to exchange the guide means and/or the spring to adapt the dampening. In order to adapt the dampening effect to the respective load condition, pursuant to one embodiment the guide means at one end section of the coil spring rests against the coil spring, and at a guide section adjoining the end section the coil spring is guided along the guide means with play. In the non-loaded state, the coil spring is held only at the end sections. When a loading of the coil spring perpendicular to its longitudinal axis occurs, the guide section of the coil spring also rests at least partially against the guide means. The effect of spring length is thereby reduced, so that the dampening effect of the coil spring increases. As a result, a good vibrational dampening and a good guide characteristic of the implement are achieved. The spacing of the guide means relative to the coil spring in the guide section, as measured in the radial direction relative to the longitudinal central axis of the antivibration element, advantageously decreases toward the center of the coil spring. As a result, the dampening effect increases as the deformation increases, resulting in a progressive spring characteristic that translates into a favorable guide characteristic.

The guide means is advantageously formed on a threaded plug that extends into the interior of the coil spring. In this connection, the threaded plug is in particular monolithically formed with a connection element. To enable a reliable guidance of the implement even if the coil spring breaks, pursuant to one embodiment the antivibration element is provided with a means for protecting against separation. Such protection means expediently include a connecting element, each end of which is held on a connection element, and which in the direction of the longitudinal central axis of the antivibration element is held with play in the non-loaded state of the antivibration element. In such a non-loaded state, or with slight deformations of the coil spring, the spring effect is not adversely affected by the means for protecting against separation. Should the deformation become greater than the play of the means for protecting against separation, such protection means represents a limitation of the deformation of the coil spring. In the event that the coil spring breaks, the two connection elements are interconnected via the connecting element of the means for protecting against separation, so that the handle does not separate from the housing. In this connection, the inclination of the antivibration element is expediently such that the means for protecting against separation holds the handle on the housing at a favorable angle.

Pursuant to one exemplary embodiment, the handle is a tubular handle. To achieve a good dampening characteristic, the second end of the handle can be connected to the housing via a second antivibration element. The longitudinal central axes of the two antivibration elements are expediently disposed at an angle of less than 90°, in particular less than 70°, and preferably at an angle of approximately 45°, relative to one another. As a result, different dampening values are provided for different load directions. Due to the inclination of the first antivibration element, the dampening values that are a function of direction can in this way be adjusted. The longitudinal central axis of the second antivibration element is in particular disposed perpendicular to the longitudinal central plane of the implement.

A simple construction of the implement is achieved if the first end of the upper handle and the tubular handle that faces the tool is secured to the housing via the first antivibration element. As a result, both handles can be connected by a common antivibration element, so that a second antivibration element can be eliminated.

Due to the configuration of the antivibration element as an element having a progressive characteristic, the coil spring must be relatively soft since in the loaded state a large portion of its length rests against the guide means and thus cannot contribute to the dampening. Such a coil spring therefore has a large number of windings. As a result, the overall size of the coil spring is lengthened, so that such an antivibration element cannot be installed in the usual installation space parallel to the longitudinal central plane of the implement. Thus, the inclination relative to the longitudinal central plane is particularly advantageous for such antivibration elements.

Further specific features of the present application will be described in detail subsequently.

DESCRIPTION OF SPECIFIC EMBODIMENTS

Referring now to the drawings in detail, the manually guided or portable implement illustrated in FIG. 1, namely a power saw 1, has a housing 2 in which is disposed an internal combustion engine, in particular a two-cycle engine. The internal combustion engine drives a saw chain that circulates on a guide bar, which is not shown in FIG. 1. The guide bar extends from the front side 41 of the housing 2 parallel to the longitudinal central plane of the power saw 1 that is defined by the longitudinal direction x and the height direction z. Also with other manually guided implements, such as cut-off machines, the tool can be disposed parallel to the longitudinal central plane of the implement. In FIG. 1, the power saw 1 is shown in the normal operating position. In this position, the upper side 3 of the housing 2 faces upwardly. Disposed on the upper side 3 of the housing 2 is an upper handle 4, a first end 13 of which is secured to the upper side 3 adjacent to the front side 41. The second end 28 of the upper handle 4 is secured on that side of the housing that is remote from the front side 41. The upper handle 4 has a handle housing 5 that is essentially hollow and is formed by a first shell 11 and a second shell 12. The separating plane of the two half shells 11 and 12 is the longitudinal central plane of the power saw 1.

The first end 13 of the upper handle 4 is connected to the housing 2 by means of a first antivibration element 6. In this connection, the first antivibration element 6 can be connected directly with the housing 2 or, for example, can be connected with the housing via the internal combustion engine that is fixedly mounted in the housing. The antivibration element 6 includes a coil spring 18, which is secured to the second half shell 12 of the handle housing 5 by means of a first connection element 15. The longitudinal central axis 26 of the coil spring 18 is inclined relative to the longitudinal central plane of the power saw 1 and extends in the transverse plane that is defined by the height direction z and the transverse direction y. The antivibration element 6 is disposed on the upper handle 4 on that side of the longitudinal central plane that faces the second half shell 12, while the other end of the antivibration element 6 is disposed on the opposite side of the longitudinal central plane that faces the first half shell 11. In this connection, the longitudinal central plane extends approximately in the geometrical middle of the power saw 1. The coil spring 18, for example in contrast to a rubber damping element, requires a lot of installation space. Since the coil spring 18 is disposed at an incline relative to the longitudinal central plane, the extension of the coil spring 18 in the height direction z is reduced, and the extension in the transverse direction y is increased. Sufficient installation space is available in the transverse direction y since the first end 13 of the upper handle 4 is wide. Due to the inclination of the longitudinal central axis 26 of the coil spring 18 relative to the central plane of the power saw 1, the first antivibration element 6 can be accommodated in the installation space that is present despite the large space requirement for the coil spring 18. The longitudinal central axis 26 of the coil spring 18 is the center line of the spring windings. For an antivibration element that does not include a coil spring, the longitudinal central axis is the axis that connects the opposite securement points of the damping element of the antivibration element.

Figure 2:
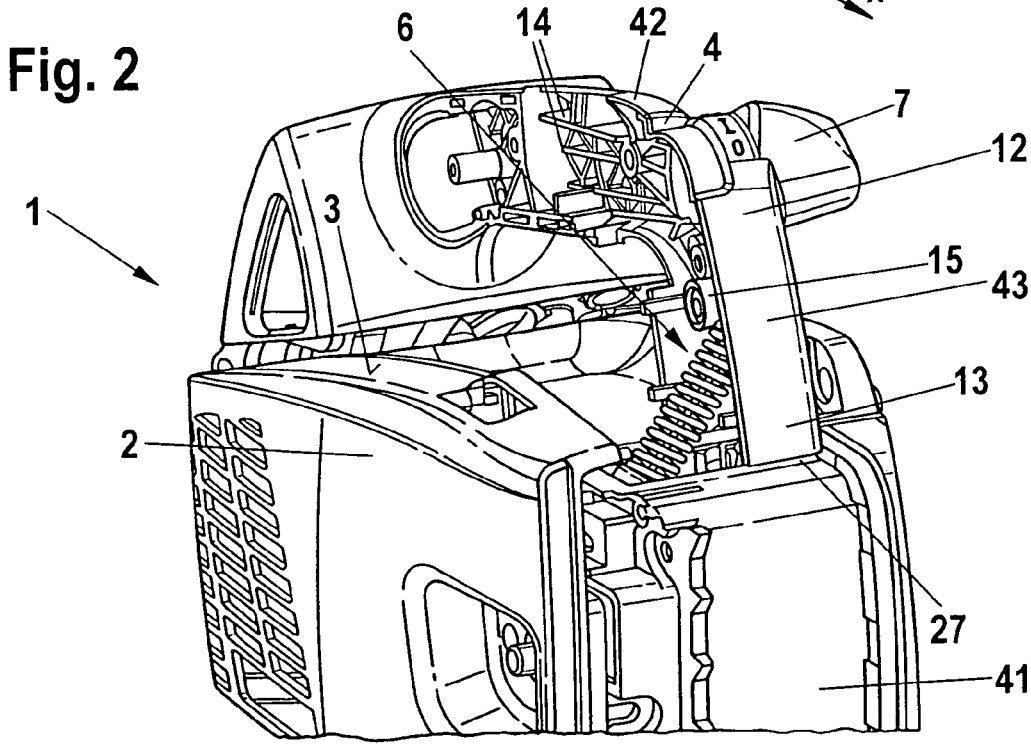
FIG. 2 shows the power saw of FIG. 1 with the handle partially sectioned in the longitudinal direction.

As shown in FIG. 2, the interior of the second half shell 12 is provided with reinforcements 14. In this way, an adequate stability of the upper handle 4, which in particular is injection molded from plastic, is achieved. The upper handle 4 has a grip portion 42, which extends substantially parallel to the upper side 3 of the housing 2 and which, approximately at the level of the front side 41 of the housing 2, merges into a connecting portion 43 that extends transverse to the grip portion 42 in the direction toward the upper side 3. In the connecting portion 43, the first antivibration element 6 is secured to the upper handle 4. In the region where the grip portion 42 merges into the connecting portion 43, a receiving means 7 for a tubular handle of the power saw 1 is formed on the second half shell 12 of the handle housing 5. Formed between the first end 13 of the upper handle 4 and the housing 2 of the power saw 1 is a gap 27 so that the upper handle 4 is movable relative to the housing 2 within prescribed limits. The first end 13 of the upper handle 4 is connected to the housing 2 only via the antivibration element 6.

Figure 3:
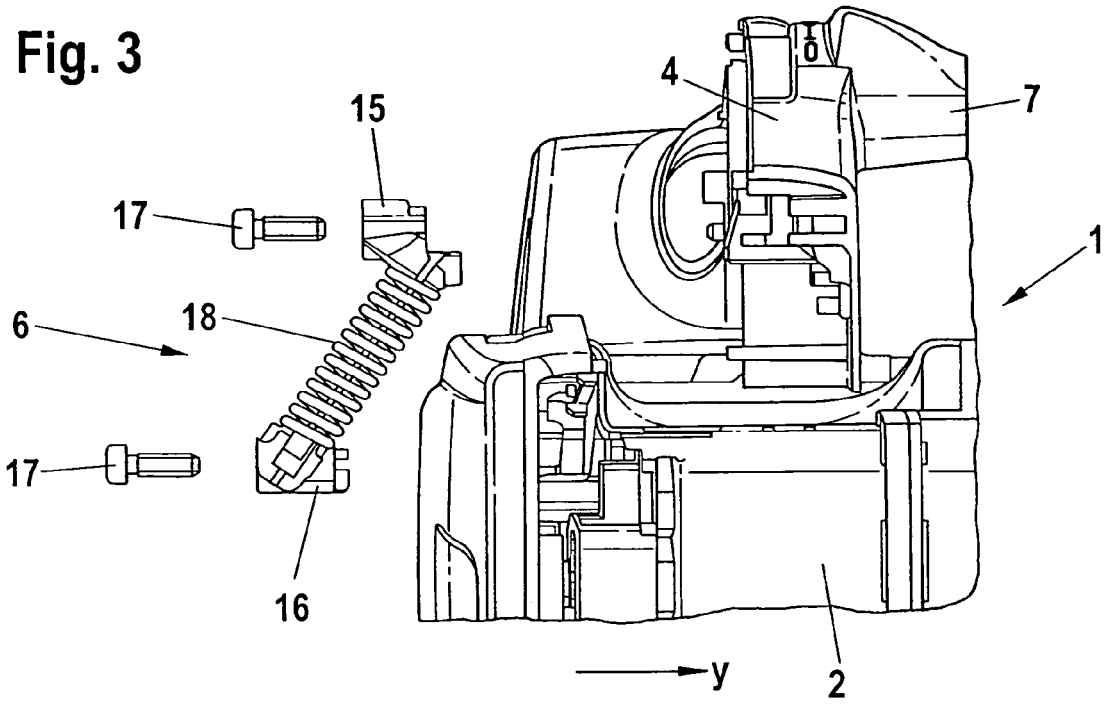
FIG. 3 illustrates the assembly of the antivibration element on the power saw.

As shown in FIG. 3, on that side that is opposite the first connection element 15, the first antivibration element 6 has a second connection element 16 via which the first antivibration element 6 is secured to the housing 2. The first connection element 15 and the second connection element 16 are secured via respective screws or bolts 17 to the upper handle 4 and the housing 2 respectively. In this connection, the two connection elements 15 and 16 are both fastened in the transverse direction y, so that the antivibration element 6 can be mounted entirely in the transverse direction y.

Figure 4:
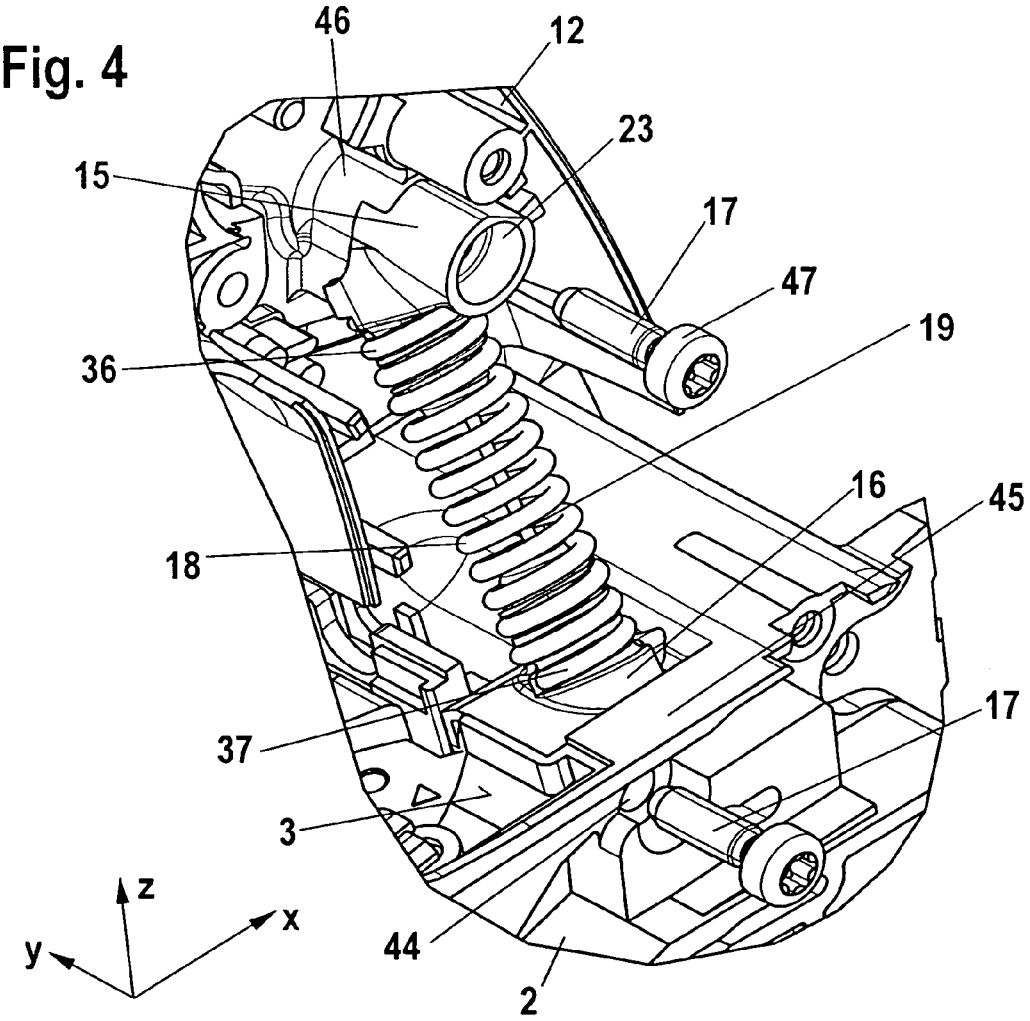
FIG. 4 is a perspective illustration of the antivibration element in a partially assembled state.

As shown in FIG. 4, the first connection element 15 has a receiving means 23 in which, in the assembled state, the head 47 of the screw 17 is disposed. The first connection element 15 has a bore at the receiving means 23 through which the screw 17 can be inserted in the transverse direction y. The screw 17 is screwed into a screw dome 46 in the second half shell 12 of the handle housing 5. The first end 36 of the coil spring 18 is secured to the first connection element 15. The opposite, second end 37 of the coil spring 18 is secured to the second connection element 16. The second connection element 16 rests against an element or crosspiece 45 of the housing 2, and is supported on the upper side 3 of the housing. The crosspiece 45 has a bore 44 that extends in the transverse direction y and through which can be inserted the screw 17. The screw 17 is then screwed into the connection element 16. A means 19 for protecting against separation extends in the interior of the coil spring 18 and will be described in greater detail subsequently.

Figure 5:
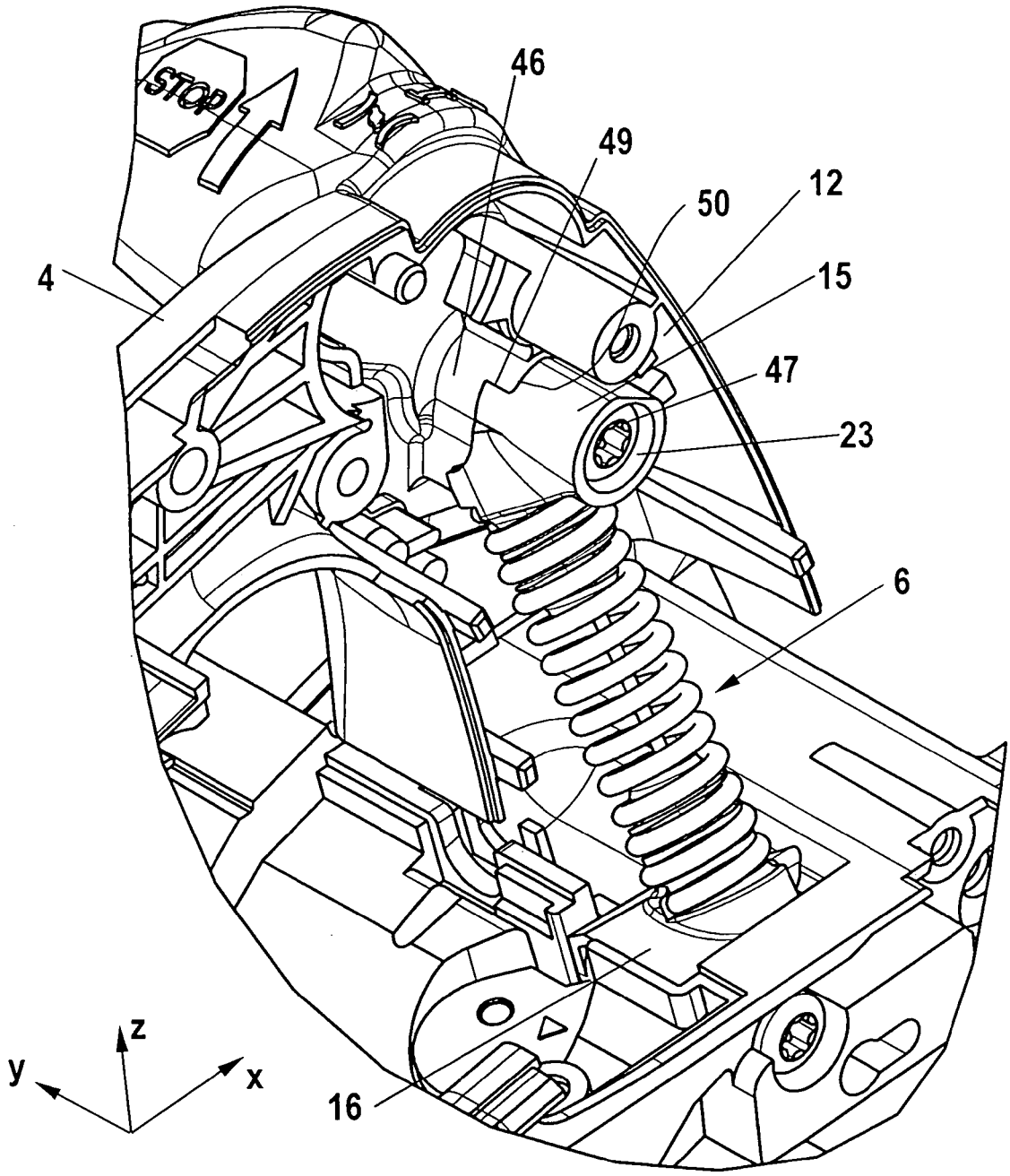
FIG. 5 is a perspective illustration of the antivibration element in the assembled state.

As shown in FIG. 5, when the antivibration element 6 is completely assembled, the head 47 of a screw 17 rests in the receiving means 23 in the first connection element 15. The screw dome 46 has a step or shoulder 49 that is disposed in a recess 50 of the first connection element 15. The shoulder 49 extends in the transverse direction y, so that the connection element 15 is supported against the shoulder 49 in the height direction z.

FIGS. 6 to 8 show the antivibration element 6 in various side views. As show in FIG. 6, the bore 51, in the first connection element 15, through which the screw 17 extends, extends parallel to the threaded bore 22, in the second connection element 16, into which the screw 17 is screwed. The bores 51 and 22 extend in the transverse direction y. The longitudinal central axes 54 and 55 of the bores 22 and 51 extend in the transverse direction y and, as also shown in FIG. 7, are disposed perpendicular to the longitudinal central plane 52. As show in FIG. 6, the antivibration element 6 is not inclined relative to the longitudinal direction x. However, it can be expedient to also incline the antivibration element 6 relative to the longitudinal direction x.

As shown by the view of the antivibration element 6 in FIG. 7 in the longitudinal direction x, in other words, upon the transverse plane defined by the transverse direction y and the height direction z, the antivibration element 6 is inclined by an angle $\beta$ relative to the longitudinal central plane 52 that is indicated in FIG. 7. The angle $\beta$ is greater than 0° and in particular is greater than 20°, preferably greater than 30°, for example approximately 45°. The antivibration element 6 is thereby separated from the longitudinal central plane 52 of the power saw 1. The longitudinal central axis 55 of the bore 51 forms an angle $\gamma$ with the longitudinal central axis 26 of the coil spring 18 that is greater than 0° and less than 90°. The angle $\delta$ between the longitudinal central axis 54 of the bore 22 and the longitudinal central axis 26 of the coil spring 18 is also less than 90° and greater than 0°. The connection elements 15 and 16 are accordingly secured in the direction y to the handle 4 and the housing 2 respectively, whereby the direction y is inclined relative to the longitudinal central axis 26 of the coil spring 18 by an angle that is less than 90° and greater than 0°. Thus, the longitudinal central axis 26 of the coil spring 18 is inclined relative to the longitudinal central axes 54, 55 of the bores 22, 51.

A threaded plug 20 (see also FIG. 9) is formed on each of the connection elements 15 and 16 and extends into the interior of the coil spring 18. The end sections 34 of the coil spring are fixedly guided onto the threaded plugs 20. At a guide section 35, which adjoins the end sections 34 in a direction toward the middle 38 of the coil spring 18, the coil spring is spaced from the threaded plugs 20 in the non-loaded state. The spacing increases in the direction toward the middle 38 of the coil spring 18. During loading, and a thereby resulting deformation, the coil spring 18 rests increasingly against the threaded plugs 20. The effective spring length is thereby reduced, so that the damping effect is increased. In this way, it is possible to realize an increasing dampening during increasing loading, resulting in a progressive spring characteristic. As a consequence of the guide sections 35, however, the coil spring 18 has a greater length l than does a dampening element that is fixedly guided at only its ends. Due to the inclined position of the antivibration element 6, however, installation can be effected without increasing the required installation space.

As shown in FIG. 8, the recess 50 of the first connection element 15, via which the connection element 15 rests against the shoulder 49, is formed as a flat portion on the cylindrical receiving means 23 for the screw 17.

Figure 9:
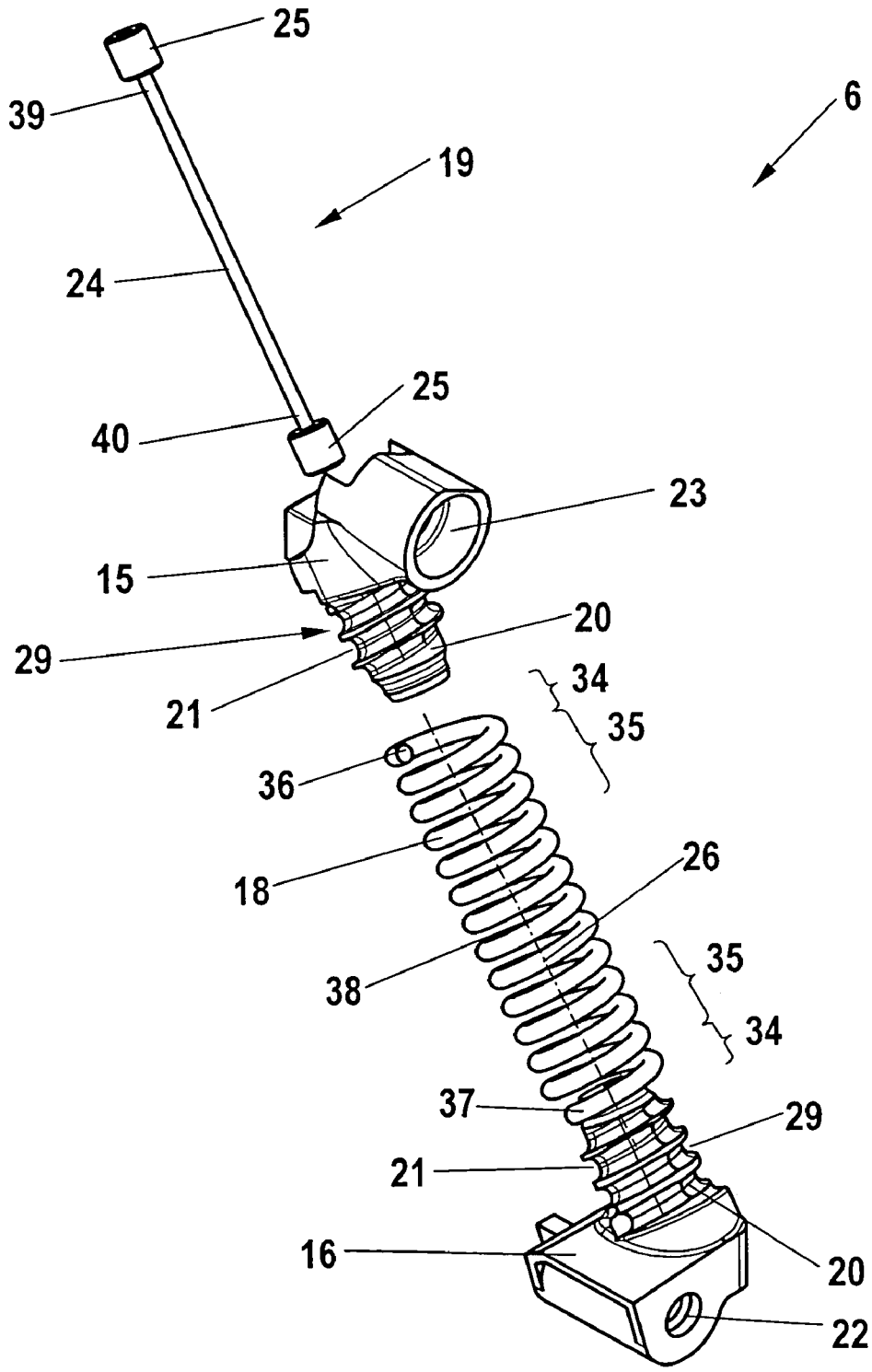
FIG. 9 is an exploded illustration of the antivibration element.

FIG. 9 is an exploded view of the antivibration element 6. Formed on the threaded plug 20 is a guide means 29 that is formed by a thread 21. The guide means 29 rests closely against the end sections 34 of the coil spring 18, while in the radial direction relative to the longitudinal central axis 26 of the coil spring 18, the guide means 29 has play relative to the guide sections 35. To assemble the antivibration element 6, the threaded plugs 20 need merely be screwed into the ends 36 and 37 of the coil spring 18. The antivibration element 6 has a means 19 for protecting against separation that is formed by a separation cable 24, on the ends 39 and 40 of which are disposed fittings 25. Each of the connection elements 15 and 16 has a non-illustrated slot, the width of which is somewhat greater than the thickness of the separation cable 24. The separation cable 24 can be mounted through the slots on the connection elements 15 and 16. In this connection, the fittings 25 rest against shoulders or the like that are formed on that side of the connection elements 15 and 16 that face away from the coil spring 18. As a result, the separation cable 24 is fixed in the direction of the longitudinal central axis 26. The separation cable 24 is held with play in the direction of the longitudinal central axis 26, i.e. its length is greater than the spacing between the two supports against which the fittings 25 are held. Consequently, without being affected by the means 19 for protecting against separation, the coil spring 18 can dampen the vibrations in a prescribed range. If the coil spring 18 breaks, the two connection elements 15 and 16 are still reliably interconnected by the separation cable 24, so that the upper handle 4 is reliably held on the housing 2.

Figure 10:
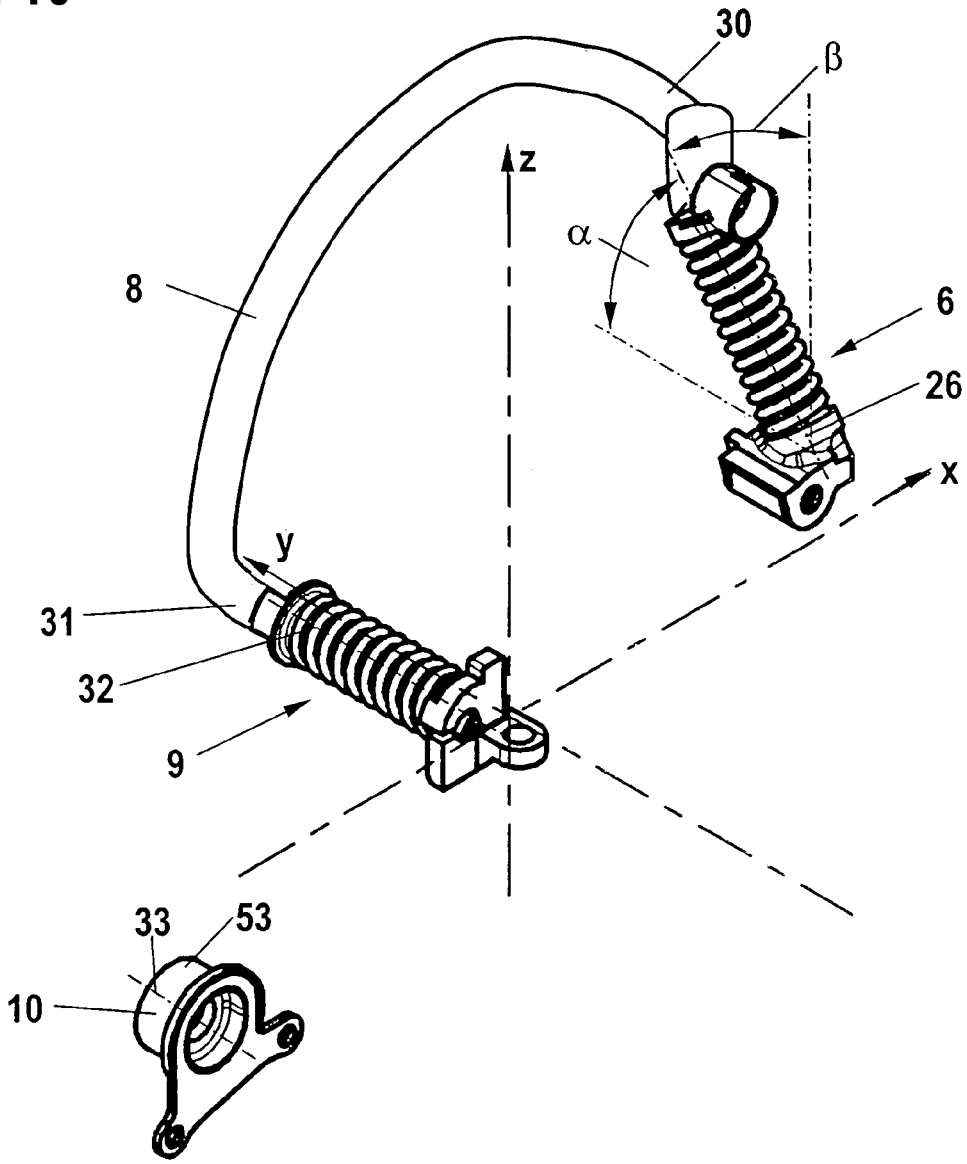
FIG. 10 is a perspective illustration of the arrangement of the antivibration elements of the power saw.

FIG. 10 shows the spatial arrangement of the antivibration elements of a power saw 1. The first antivibration element 6, at which the upper handle 4 is secured to the housing 2, is inclined by an angle $\beta$ relative to the longitudinal central plane of the power saw 1. The second end 28 of the upper handle 4, which is show in FIG. 1, is secured to an antivibration element 10 that is in the form of a rubber element and connects the upper handle 4 to the housing 2. The longitudinal central axis 33 of the second antivibration element 10; which axis is perpendicular to the mountings of the dampening body 53, and which represents the geometrical center line of the dampening body, is disposed parallel to the transverse direction y. The longitudinal central axis 26 of the first antivibration element 6 forms an angle $\alpha$ with the longitudinal central axis 33 of the second antivibration element 10 that is less than 90°, in particular less than 70° and preferably approximately 45°.

The first end 30 of a tubular handle 8 is secured to the receiving means 7, which is schematically illustrated in FIG. 10. The second end 31 of the tubular handle 8 is secured to a second antivibration element 9, the longitudinal central axis 32 of which extends parallel to the transverse direction y. The antivibration element 9 also includes a coil spring. Furthermore, the antivibration element 9 can also have a progressive spring characteristic. Due to the fact that the first antivibration element 6 is inclined at an angle α to the second antivibration elements 9 and 10, different dampenings result in different directions.

FIGS. 11 to 15 show exemplary embodiments of antivibration elements that could be used in place of the first antivibration element 6 and/or instead of the second antivibration element 9. The exemplary embodiments show antivibration elements where the coil spring itself has a nonlinear characteristic. As a result, the dampening properties can be optimally adapted. As a consequence of the nonlinear characteristic, it is possible to further reduce the overall size of the antivibration element.

Figure 11:
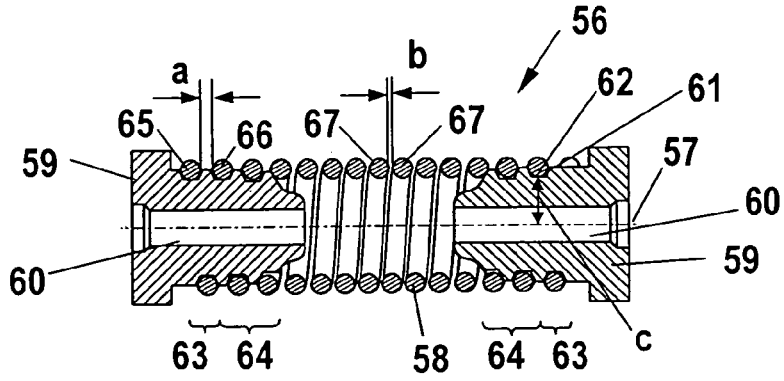
FIGS. 11 to 15 are cross-sectional illustrations of various exemplary embodiments of antivibration elements.

FIG. 11 shows an antivibration element 56 having a coil spring 58 that is held between two threaded plugs 59. These plugs have a central bore 60, the longitudinal central axis of which coincides with the longitudinal central axis 57 of the coil spring 58. However, as described in conjunction with the embodiment of FIGS. 1 to 10, the bores 60 can also be inclined relative to the longitudinal central axis 57. The threaded plugs 59 have a helical groove 61 in which the coil spring 58 is guided. In the end sections 63 of the coil spring 58, the coil spring is disposed in the groove 61 and is thus fixedly guided. In the guide sections 64 that adjoin the end sections 63, the coil spring 58 is guided with play in the groove 61. The base 62 of the groove 61 is spaced by a distance c from the longitudinal central axis 57 of the coil spring 58, with this distance being reduced in a direction toward the center of the coil spring 58. As a result, the windings in the guide sections 64 can spring or deflect at a slight loading and can thus contribute to the dampening effect. At greater deformations, the windings in the guide sections 64 rest against the threaded plugs 59, so that the effective spring length is reduced and hence the stiffness of the spring is increased. In the end section 63, the last winding 65 is spaced by a distance a from the adjacent winding 66. In the region of the middle of the coil spring 58, two adjacent windings 67 are spaced from one another by a distancing b that is less than the distance a. When loading is encountered, the windings in the region of the center of the coil spring rest against one another and thus no longer contribute to the spring effect. As a result, the stiffness increases as the spring deflection or travel advances. Thus, the characteristic of the coil spring 58 is itself nonlinear, independently of the threaded plugs 59.

Figure 12:
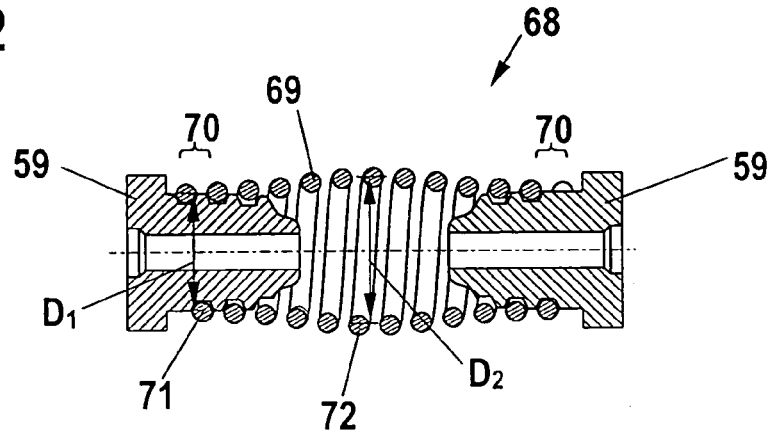

With the embodiment shown in FIG. 12, the coil spring 69 of the antivibration element 68 has a barrel-shaped configuration. The winding 71 in the region of the end sections 70 of the coil spring 69 have a winding diameter $D_1$ that is less than the winding diameter $D_2$ of the winding 72 in the region of the center of the coil spring. The winding diameter increases continuously from the end sections 70 in a direction toward the center of the coil spring. The coil spring 69 is screwed onto two threaded plugs 59 that correspond to the plugs of FIG. 11. In the region of the greater winding diameter $D_2$, the coil spring 69 has a lesser stiffness. As a result, the windings 72 rest more rapidly against one another, so that the number of windings that deflect is reduced at greater loads, and the spring stiffness is increased. The coil spring 69 accordingly also has a nonlinear characteristic.

Figure 13:
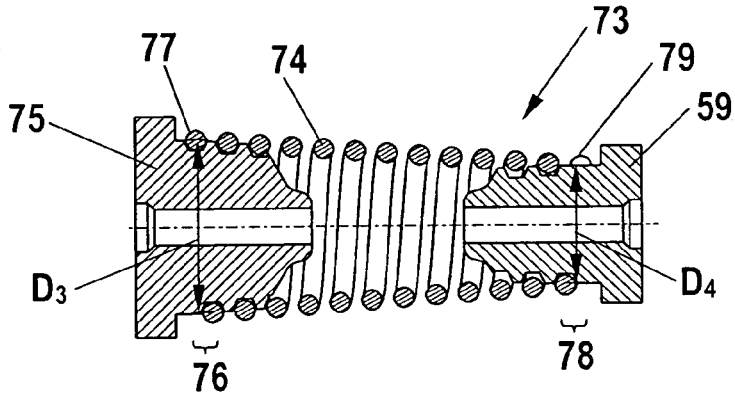

The coil spring 74 of the antivibration element 73 shown in FIG. 13 has a conical shape. The coil spring 74 is held on a threaded plug 59 as well as on a threaded plug 75. The plug 75 has a greater diameter than does the plug 59. The winding 77 in the end section 76 that is screwed onto the threaded plug 75 has a winding diameter $D_3$. At the opposite end section 78, the winding 79 has the winding diameter $D_4$ which is less than the winding diameter $D_3$. The winding diameter decreases continuously from the diameter $D_3$ to the diameter $D_4$. This results in a lower spring stiffness of the coil spring 74 at the end that faces the threaded plug 75. This leads at this end to a greater spring travel and hence to the windings resting more rapidly against one another under load, with such windings no longer contributing to the spring effect. The result is a nonlinear, progressive characteristic.

Figure 14:
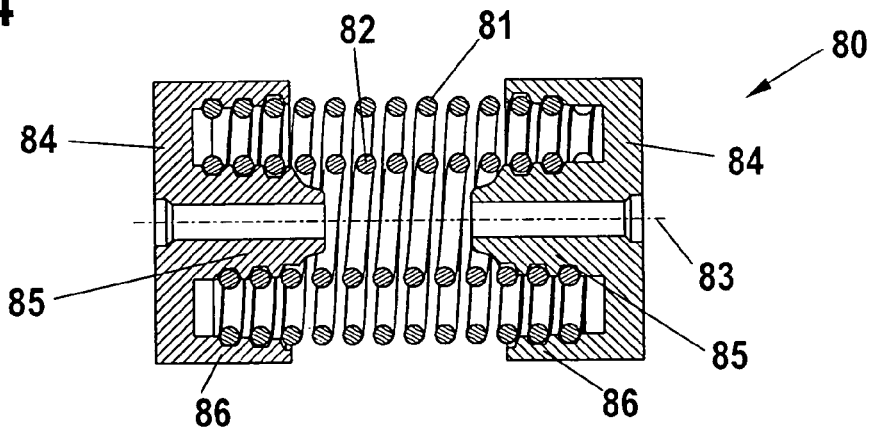

The antivibration element 80 illustrated in FIG. 14 has two coil springs 81, 82 that are disposed concentrically relative to one another, and that each have a nonlinear characteristic. The longitudinal central axis of the two coil springs 81, 82 coincides with the longitudinal central axis 83 of the antivibration element 80. The two coil springs are held in guide elements 84. These guide elements each have a threaded plug 85 that is screwed into the inner coil spring 82 and holds the latter in its inner periphery. Formed on each threaded plug 85 is a pot-shaped portion 86 that extends about the two springs 81, 82 and holds the outer coil spring 81 along it outer periphery. Due to the parallel arrangement of the two coil springs 81, 82 with their nonlinear characteristics, it is possible to achieve a good adaptation of the dampening effect in a simple manner.

Figure 15:
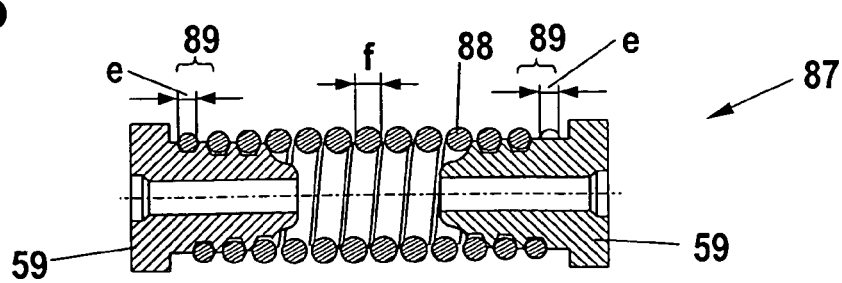

The antivibration element 87 shown in FIG. 15 has a coil spring 88 that is held on a threaded plug 59. In its end sections 89, the spring wire of the coil spring 88 has a thickness e, and in the region of the center of the coil spring 88 the spring wire has a thickness f that is greater than the spring wire thickness e. Proceeding from the end sections 89, the spring wire thickness increases continuously until it achieves the thickness f. In the region of the center of the coil spring 88 several windings have the spring wire thickness f. The greater spring wire thickness f in the region of the center of the coil spring effects a greater stiffness and leads to the windings in the region of the ends of the coil spring resting against one another first. This also results in a nonlinear characteristic.

In the exemplary embodiments of FIGS. 11 to 15 the bores for the securement of the threaded plugs are respectively illustrated as being concentric to the longitudinal central axis. However, they can also be inclined relative to the longitudinal central axis. Furthermore, other coil springs having nonlinear spring characteristics can also be utilized.

The specification incorporates by reference the disclosure of German priority document DE 10 2004 031 866.2 filed 1 Jul. 2004.

The present invention is, of course, in no way restricted to the specific disclosure of the specification and drawings, but also encompasses any modifications within the scope of the appended claims.

We claim:

1. A manually guided implement comprising:

a housing which accommodates an internal combustion engine for driving a tool;

at least an upper handle that extends in the longitudinal direction of the implement on an upper side of the implement; and a first antivibration element for connecting the upper handle to the housing, wherein a longitudinal central axis of the first antivibration element is inclined relative to a longitudinal central plane of the implement.

2. An implement according to claim 1, wherein said first antivibration element connects a first end of said upper handle to said housing, and wherein said first end of said upper handle faces the tool.

3. An implement according to claim 1, which includes a first connection element and a second connection element, and wherein said first antivibration element is connected to said handle via said first connection element and is connected to said housing via said second connection element.

4. An implement according to claim 3, wherein said first and second connection elements are respectively secured by at least one fastening element to said handle and said housing respectively.

5. An implement according to claim 3, wherein said first and second connection elements are both assembled in the same direction.

6. An implement according to claim 3, wherein one of said first and second connection elements is provided with a bore for a fastening element and wherein longitudinal central axes of said bores are inclined relative to the longitudinal central axis of said first antivibration element.

7. An implement according to claim 1, wherein said first antivibration element includes a coil spring.

8. An implement according to claim 7, which includes a guide means, and wherein at least one end of said coil spring is held on said guide means.

9. An implement according to claim 8, wherein said guide means is in the form of a thread.

10. An implement according to claim 8, wherein at an end section of said coil spring, said guide means rest against said coil spring, and wherein at a guide section of said coil spring, that adjoins said end section, said coil spring is guided with play along said guide means.

11. An implement according to claim 10, wherein a spacing of said guide means relative to said coil spring in said guide section, which spacing is measured in a radial direction relative to the longitudinal central axis of said antivibration element, decreases in a direction toward a center of said coil spring.

12. An implement according to claim 8, wherein said guide means is formed on a threaded plug that extends into an interior of said coil spring.

13. An implement according to claim 12, wherein said threaded plug is monolithically formed with a connection element, by means of which said first antivibration element is connected to said handle and said housing respectively.

14. An implement according to claim 7, wherein said antivibration element is provided with a means for protecting against separation.

15. An implement according to claim 14, wherein said means for protecting against separation includes a connecting element, each end of which is held on a connection element by means of which said first antivibration element is connected to said handle and said housing respectively, and wherein said connecting element is held with play, in the direction of said longitudinal central axis of said antivibration element 6, in a non-loaded state of said antivibration element.

16. An implement according to claim 1, wherein said implement is provided with a tubular handle.

17. An implement according to claim 1, wherein a second end of a handle of said implement is connected to said housing via a second antivibration element.

18. An implement according to claim 17, wherein longitudinal central axes of said first and second antivibration elements are disposed at an angle of less than 90°, in particular less than 70°, and preferably at an angle of approximately 45°, relative to one another.

19. An implement according to claim 17, wherein a longitudinal central axis of said second antivibration element is disposed perpendicular to said longitudinal central plane of said implement.

20. An implement according to claim 16, wherein first ends of said upper handle and said tubular handle, which ends face the tool, are secured to said housing via said first antivibration element.

* * * * *